US005207338A

United States Patent [19]

Sandhu

[11] Patent Number: 5,207,338

[45] Date of Patent: May 4, 1993

[54] INFANT NURSING BOTTLE

[76] Inventor: Rajdeep S. Sandhu, 1540 Maurice La., #49, San Jose, Calif. 95129

[21] Appl. No.: 847,605

[22] Filed: Mar. 4, 1992

[51] Int. Cl.[5] ..... A61J 9/00; B65D 23/10

[52] U.S. Cl. ..... 215/11.1; 215/100 A; 215/12.1; 220/771; 220/772; 220/428; D7/534; D24/197

[58] Field of Search ..... 215/11.1, 11.2, 11.6, 215/100 A, 12.1, 12.2, 13.1; 220/703, 94 A, 753, 771; D7/534, 510; D24/197

[56] References Cited

U.S. PATENT DOCUMENTS

D. 192,978 6/1962 Garvey .
D. 199,699 12/1964 Dailey .
D. 210,513 3/1968 Laughlin .
D. 212,921 12/1968 Bloomberg .
D. 214,871 8/1969 Tompkins .
D. 216,248 12/1969 Hill .
D. 221,513 8/1971 Leary et al. .
D. 221,514 8/1971 Leary et al. .
D. 221,515 8/1971 Betka .
D. 221,516 8/1971 Crisci .
D. 221,517 8/1971 Luedtke .
D. 224,200 7/1972 Kretz .
D. 229,723 12/1973 Grimes .
D. 239,697 4/1976 Hunt .
D. 240,968 8/1976 Hurst .
D. 273,276 4/1984 Klim .
D. 276,791 12/1984 Field .
D. 283,396 4/1986 Bouthillier .
D. 284,220 1/1986 Pote .
D. 307,477 4/1990 Gonzalez et al. ..... D24/197
595,414 12/1897 Roach .
1,037,309 9/1912 Poore .
1,617,213 2/1927 La Paugh ..... 215/11.1 X
1,637,719 8/1927 Whitlock .
1,839,401 1/1932 Luxardo et al. .
2,722,086 11/1955 Mullen .
2,789,002 4/1957 Nicholas .
2,792,696 5/1957 Stayart ..... 215/11.1 X
2,793,778 5/1957 Maxwell .
2,805,561 9/1957 Emmert et al. ..... 215/12.1 X
2,831,596 4/1958 Eyles .
2,843,281 4/1958 Gallois .
2,859,891 11/1958 Carkin .
2,926,805 3/1960 Mead ..... 215/11.1
2,978,131 4/1961 Garvey .
2,986,296 5/1961 Bannister et al. .
3,075,666 1/1963 Hoffstein .
3,105,324 10/1963 Friedman .
3,145,867 8/1964 Roberts .
3,161,311 12/1964 Boston .
3,171,559 3/1965 Ferree .
3,195,752 4/1965 Cox .
3,214,052 10/1965 Dike .

(List continued on next page.)

*Primary Examiner*—Allan N. Shoap
*Assistant Examiner*—Vanessa Caretto
*Attorney, Agent, or Firm*—John J. Leavitt

[57] ABSTRACT

Presented is an infant nursing bottle that facilitates grasping and holding of the bottle by an infant during feeding. The nursing bottle is formed symmetrical about a longitudinal axis and includes a central hollow portion. Projecting from diametrically opposite sidewalls of the central hollow portion are outwardly extending handles that are spaced from the side of the central hollow portion to provide a recess through which the fingers of an infant may extend to curl around the handle and grasp and hold the bottle during nursing. In one aspect, the handles are hollow and communicate with the interior of the hollow central portion to thus increase the volumetric capacity of the bottle. In another aspect, the handles are hollow, but do not communicate with the interior of the central hollow portion. Rather, the interior of the handles are filled with a colored liquid that is decorative to enhance the appearance of the nursing bottle, or the liquid trapped within the hollow handles contains floating objects, such as bubbles or beads, that have a certain degree of mobility within the handle to provide a visual focal point. In its other aspects, the outwardly extending handles are fabricated from a solid material, and may be formed from material having a different or the same color as the central hollow portion.

4 Claims, 6 Drawing Sheets

U.S. PATENT DOCUMENTS

| | | | |
|---|---|---|---|
| 3,718,360 | 2/1973 | Knutzen | 215/11.6 X |
| 3,746,198 | 4/1973 | Howland . | |
| 3,804,952 | 4/1974 | MacDonald . | |
| 3,990,596 | 11/1976 | Hoftman | 215/11.1 |
| 4,193,699 | 3/1980 | Haygeman et al. | 220/94 A X |
| 4,557,392 | 12/1985 | Ryan et al. . | |
| 4,558,792 | 12/1985 | Cabernoch et al. . | |
| 4,570,808 | 2/1986 | Campbell et al. . | |
| 4,700,856 | 10/1987 | Campbell et al. | 215/11.1 X |
| 4,813,556 | 3/1989 | Lawrence | 215/11.3 |
| 4,867,325 | 9/1989 | Dransfield . | |
| 4,878,588 | 11/1989 | Ephraim | 215/11.2 |
| 4,917,252 | 4/1990 | Chambers et al. | 215/11.1 |
| 4,940,151 | 7/1990 | Fett | 215/11.1 |
| 4,941,579 | 7/1990 | Lee | 215/11.1 |
| 4,941,590 | 7/1990 | Pantaleo et al. | 220/428 |
| 4,943,017 | 7/1990 | Ennis | 215/100 A X |
| 5,038,948 | 8/1991 | Signorini | 215/11.1 |
| 5,038,948 | 8/1991 | Signorini | 215/11.1 |

INFANT NURSING BOTTLE

BACKGROUND OF THE INVENTION

1. Field of the Invention

This invention relates to infant nursing bottles, and particularly to an infant nursing bottle configured to facilitate grasping of the bottle by an infant during self-feeding and which also facilitates washing the interior of the bottle upon completion of feeding.

2. Description of the Prior Art

The literature is replete with infant nursing bottles of different sizes and configurations. Some of these are configured to facilitate washing, with little or no consideration given to the need for the infant to hold the bottle during feeding. Others are configured to facilitate manufacture, with little or no consideration given to either the need to wash the bottle, or the need for the infant to hold the bottle during feeding. Still others appear to be configured to facilitate holding of the bottle by an infant, but neglect the need to wash the interior of the bottle after a feeding. The prior art patents reviewed include the following:

| | | | |
|---|---|---|---|
| 47,650 | 210,501 | 221,518 | 2,307,390 |
| 71,125 | 210,513 | 221,519 | 2,586,199 |
| 86,570 | 214,871 | 224,200 | 2,722,086 |
| 92,518 | 216,248 | 239,697 | 2,978,131 |
| 124,394 | 221,513 | 240,968 | 3,171,559 |
| 183,940 | 221,514 | 273,276 | 3,195,752 |
| 187,360 | 221,515 | 276,790 | 3,214,052 |
| 192,970 | 221,516 | 276,791 | 3,232,495 |
| 199,699 | 221,517 | 283,396 | |

Some of the patents listed above do not relate to infant nursing bottles per se, but are nevertheless included in the interest of completeness of the disclosure of prior art as it is presently known by me. Prior art patents reviewed that appear to have the greatest pertinency to infant nursing bottles include the following:

| | | | |
|---|---|---|---|
| 18,420 | 1,637,719 | 2,986,296 | 4,557,392 |
| 212,921 | 1,668,227 | 3,075,666 | 4,558,792 |
| 229,723 | 1,947,753 | 3,804,952 | 4,557,392 |
| 284,220 | 2,789,002 | 3,105,324 | 4,570,808 |
| 595,414 | 2,793,778 | 3,145,867 | 4,867,325 |
| 1,037,309 | 2,831,596 | 3,161,311 | |
| 1,375,917 | 2,843,281 | 3,746,198 | |
| 1,617,213 | 2,859,891 | | |

By observation of infants while being fed with the aid of a nursing bottle, it has been noted that it is very common for even tiny infants to attempt to grasp the nursing bottle. By the time infants are about four months old, most are able to independently hold the bottle during the feeding procedure. Some infants achieve this level of dexterity at an even younger age. Accordingly, one of the important objects of the present invention is the provision of an infant nursing bottle configured to facilitate grasping and properly positioning of the bottle by very young infants during feeding.

Infant nursing bottles in years past were fabricated from glass. While glass infant nursing bottles are still available, it appears that by far the majority of infant nursing bottles are now fabricated from appropriate synthetic resinous materials. Accordingly, another object of the invention is the provision of an infant nursing bottle configured to facilitate grasping of the bottle by the infant, and fabricated from a suitable synthetic resinous material.

Regarding washing of the interior of infant nursing bottles, some of the bottles are configured in such a manner that washing or sterilizing the interior of the bottle is most difficult. It is therefore another object of the present invention to provide an infant nursing bottle fabricated from synthetic resinous material in a manner and with a configuration that facilitates cleansing of the interior of the bottle.

As infants become more adept at holding the nursing bottle during feeding, they frequently will hold the bottle with two hands, one on either side of the bottle, but sometimes they will hold the bottle with only one hand. It is therefore a still further object of the invention to provide an infant nursing bottle configured to enable an infant to utilize either both or only a single hand in holding the bottle during feeding.

From inspection of the prior art patents listed above relating to infant nursing bottles, it is surprising to note that consideration has not been given to decorative aspects of infant nursing bottles. Accordingly, a still further object of the invention is the provision of an infant nursing bottle that incorporates decorative aspects that are attractive to the infant.

The invention possesses other objects and features of advantage, some of which, with the foregoing will be apparent from the following description and the drawings. It is to be understood however that the invention is not limited to the embodiments illustrated and described, since it may be embodied in various forms within the scope of the appended claims.

SUMMARY OF THE INVENTION

In terms of broad inclusion, the infant nursing bottle of the invention incorporates four aspects that address one or more of the needs discussed above relating to facilitating grasping and holding of the bottle by the infant during feeding, the facility of washing and sterilizing the interior of the bottle following a feeding, the facility of manufacture, and decoration of the nursing bottle to enhance its attractiveness. In all aspects, the nursing bottle is formed symmetrical about a longitudinal axis and includes a central hollow portion constituting the primary container for liquid nourishment, such as milk or fruit juice. Projecting from diametrically opposite sidewalls of the central hollow portion are outwardly extending handles that are spaced from the side of the central hollow portion to provide a recess through which the fingers of an infant may extend to curl around the handle and thus grasp and hold the bottle during nursing. In one aspect, the handles are hollow and communicate with the interior of the hollow central portion to thus increase the volumetric capacity of the bottle. In another aspect, the handles are hollow, but do not communicate with the interior of the central hollow portion. Rather, the interior of the handles are filled with a colored liquid that is decorative to enhance the appearance of the nursing bottle, or the liquid trapped within the hollow handles contains floating objects, such as bubbles or beads, that have a certain degree of mobility within the handle to provide a visual focal point. In its other aspects, the outwardly extending handles are fabricated from a solid material, and may be formed from material having a different or the same color as the central hollow portion. In one of these the handles are positioned generally medianly with respect to the longitudinal dimension of the bottle, while in the other the handles are positioned closer to the outlet of the bottle than to the closed end of the bottle. In all aspects, the open end of the bottle is provided with means for attaching an appropriate nipple assembly through which an infant may draw liquid from the interior of the bottle.

DESCRIPTION OF THE PREFERRED EMBODIMENT

Figure 1:
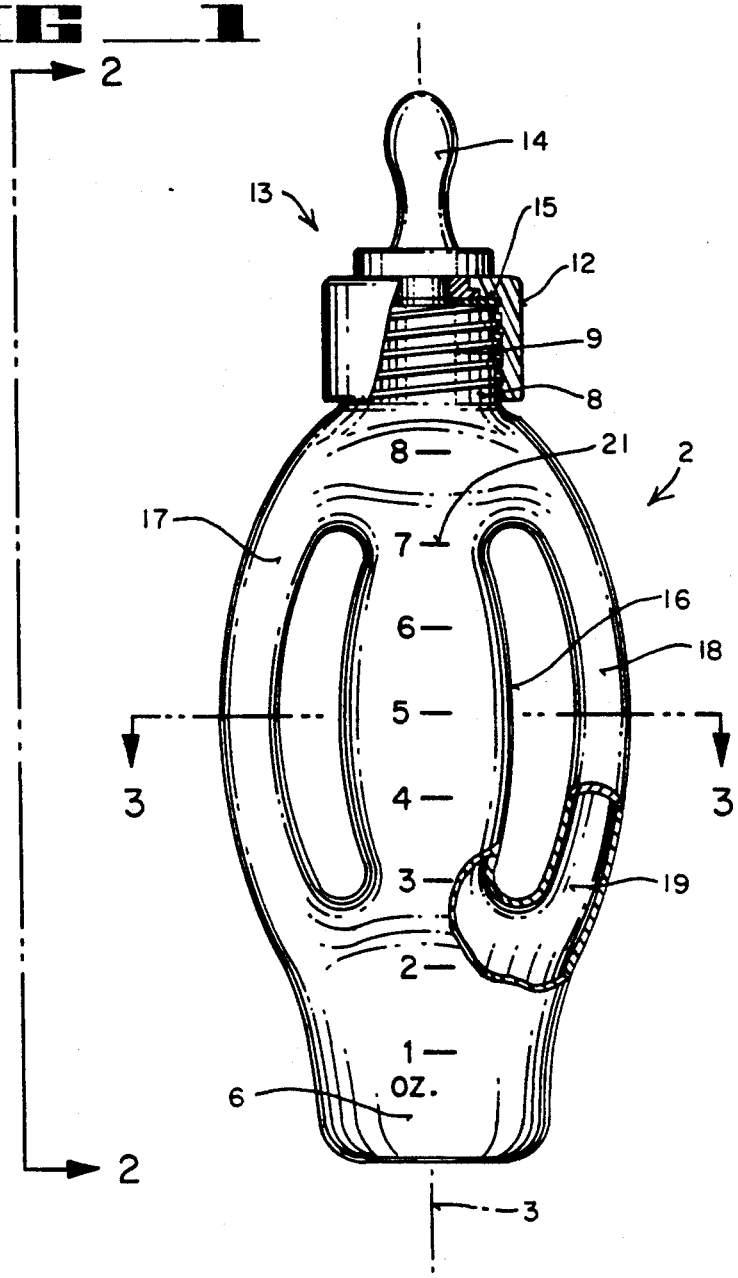
FIG. 1 is a front elevational view of an infant nursing bottle according to one embodiment of the invention.
Figure 3:
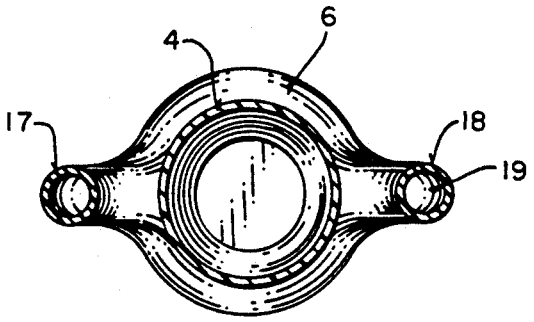
FIG. 3 is a horizontal cross-sectional view of the infant nursing bottle of FIG. 1 taken in the plane indicated by the line 3—3 in FIG. 1.
Figure 2:
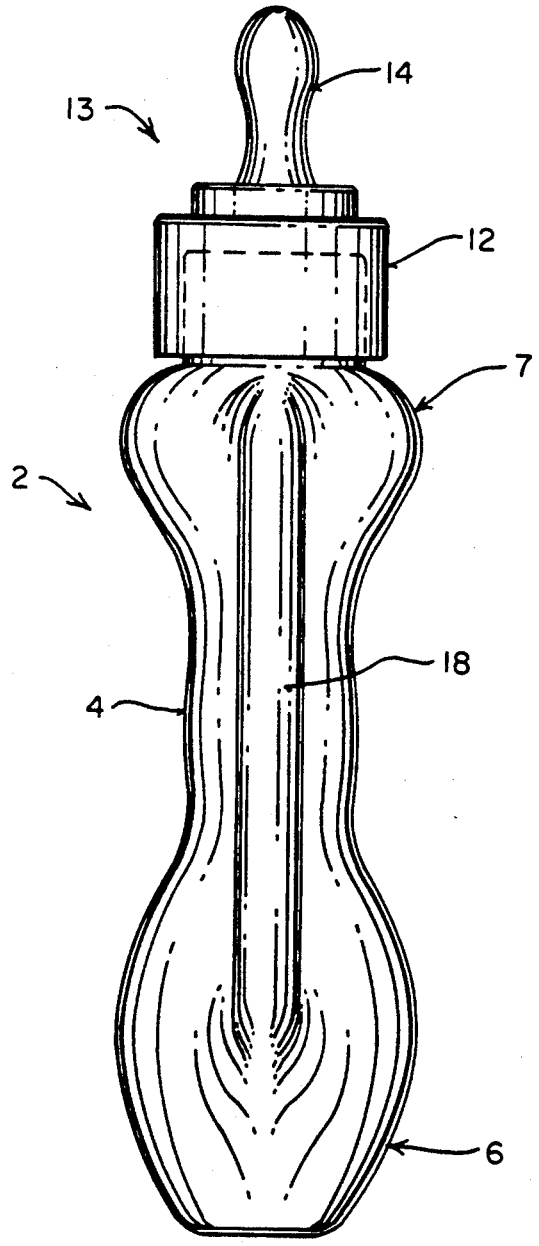
FIG. 2 is a side elevational view of the infant nursing bottle of FIG. 1.

In terms of greater detail, and referring to the embodiment of the invention illustrated in FIGS. 1, 2 and 3, the infant nursing bottle of the invention is designated generally by the numeral 2 and as there shown comprises an elongated container symmetrical about a longitudinal axis 3 and having a hollow central portion 4 communicating with a hollow bottom portion 6 and an upper hollow portion 7. Adjacent the upper hollow portion 7, the infant nursing bottle is provided with a tubular cylindrical flange 8 having appropriate threads 9 for engagement by the cylindrical flange 12 of a nipple assembly designated generally by the numeral 13, and including a nipple 14. As is usual, the complementarily threaded cap 12 threadably engages the threads 9 on the flange 8, and in doing so, seals an underlying nipple flange 15 having a central aperture communicating with the interior of the nipple 14 to permit milk or other liquid to be drawn from the bottle through the nipple and into the infant's mouth.

Because of the likelihood of a nursing bottle being discarded by an infant and falling off of a bed onto a hard floor, it is preferred that the nursing bottle be fabricated from a generally resilient synthetic resinous material rather than glass. Accordingly, referring to FIGS. 1 and 3, it will be seen that the central hollow portion 4 of the bottle is generally tubular for its entire length, bulging slightly at its midpoint 16, and tapering slightly toward each end where the hollow central portion communicates with the hollow portions 6 and 7 at opposite extreme ends of the bottle.

Extending laterally from the hollow central portion are a pair of diametrically opposed handles 17 and 18, each of the handles being curved to conform to the bulge 16 of the hollow central portion of the bottle, each handle being generally cylindrical as illustrated in FIG. 3, and hollow, as shown in FIG. 1, so that the interior 19 of each of the handles communicates with the interior of the nursing bottle in general. Thus, liquid poured into the nursing bottle through the opening in the flange 8, will find its own level in the hollow central portion and in the outwardly extending handle portions 17 and 18. In like manner, when the nursing bottle is tipped up for nursing purposes, the milk or other liquid within the bottle will flow in the handle portions as easily as it will flow in the hollow central portion of the bottle. Preferably, the jointure of each of the handle 17 and 18 with the hollow central portion of the bottle occurs on opposite sides of a plane that bisects the bottle medianly as indicated by the line 3—3, so that when the infant grasps the two handles 17 and 18 in its tiny hands, the weight of the bottle and the liquid which it contains will be balanced to facilitate holding of the bottle by the infant. As indicated on one side of the bottle, the volumetric content of the bottle may be indicated by appropriate graduations 21 marked directly on the side of the bottle as by embossing during the molding process of the bottle, or by appropriate printing.

Figure 4:
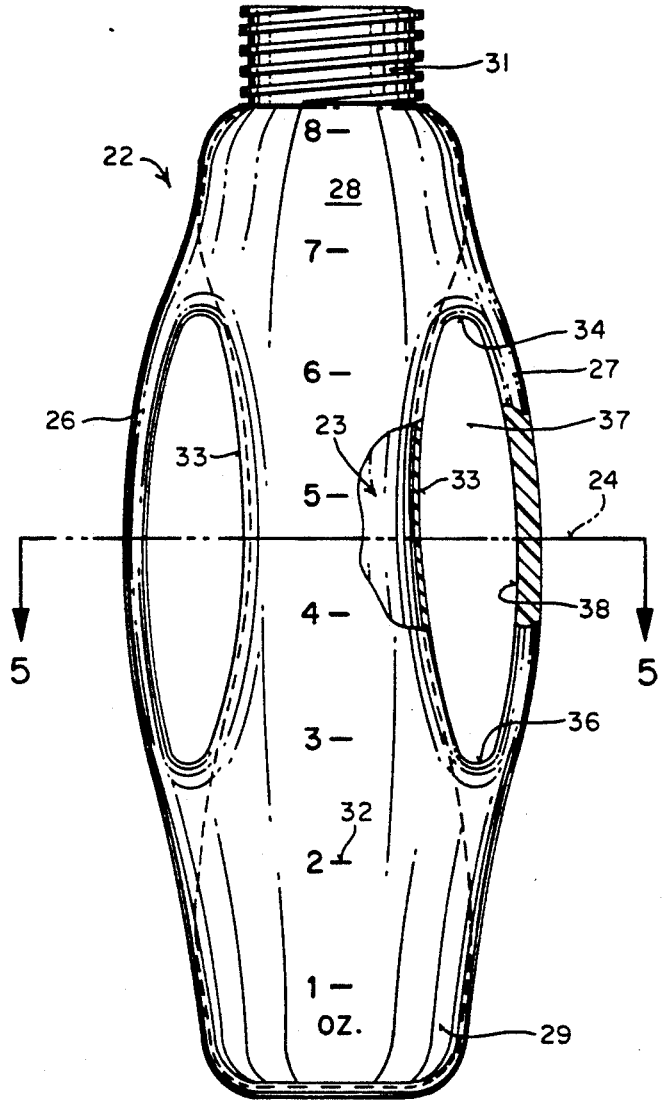
FIG. 4 is a front elevational view of a second embodiment of the infant nursing bottle of my invention.
Figure 5:
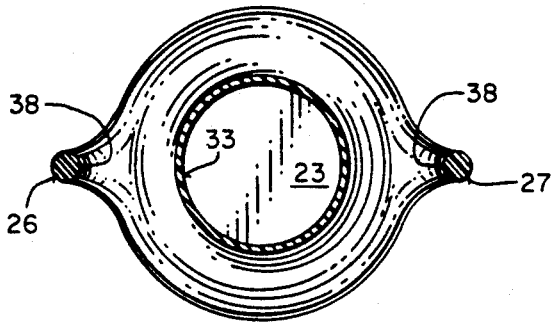
FIG. 5 is a fragmentary horizontal sectional view taken in the plane indicated by the line 5—5 in FIG. 4.

Referring to the embodiment of the invention illustrated in FIG. 4, it is noted that this infant nursing bottle is designated generally by the numeral 22, and includes a central hollow portion 23 the sides of which, rather than bulging outwardly as in the embodiment illustrated in FIG. 1, instead are concave as illustrated, having a somewhat smaller diameter along the median plane 24 so that as an infant grows and becomes larger, with larger hands, the hollow central portion 23 may itself be grasped by the infant to hold the bottle. Until the infant reaches that point in its growth however, the bottle is provided with radially outwardly extending diametrically opposed handles 26 and 27 which are preferably formed from solid material, in contrast to the hollow construction of the embodiment illustrated in FIG. 1. These handles 26 and 27 integrally join the side wall of the bottle 22 but do not have a hollow interior that communicates with the interior of the bottle. It should be noted that the infant bottle 22 is also provided with a top hollow portion 28 and a hollow bottom portion 29 communicating with the interior of the hollow central portion 23 to contain an appropriate liquid such as milk or fruit juice. The handles 26 and 27 integrally join the side wall of the hollow bottle, the upper end of the handles 26 and 27 joining the side wall at an outwardly projecting shoulder therein, while the lower ends of the handles 26 and 27 join the lower hollow portion 29 below the "waist" of the hollow central portion 23. It should be noted that the outer periphery of the handles 27 viewed as in FIG. 4 form a smooth curvature with the upper and lower hollow portions of the bottle to provide a distinctive and attractive appearance to the infant nursing bottle. Additionally, it is noted that in this embodiment, the nipple assembly has been omitted, it being understood that the nipple assembly is a conventional structure that is applicable to the threaded tubular mounting portion 31 integrally molded on the body, which is preferably molded from a synthetic resinous material. As with the embodiment illustrated in FIG. 1, the embodiment of the infant nursing bottle illustrated in FIG. 4 is provided with appropriate graduations 32 to indicate the volumetric capacity of the bottle.

Referring to FIG. 4, it should be noted that the union of the handles 26 and 27 with the side wall 33 of the hollow central portion is rounded as indicated at 34 and 36 so that there is no possibility that the infant's fingers will become jammed in a tight "bight" between these two members. Additionally, the opening 37 formed between the side wall 33 of the hollow central portion of the infant nursing bottle and the inner surface 38 of the handles 26 and 27 is sufficiently large to permit the infant to insert its fingers and perhaps even its palm so as to easily grasp the handles 26 and 27 to hold the bottle in a feeding position.

Figure 6:
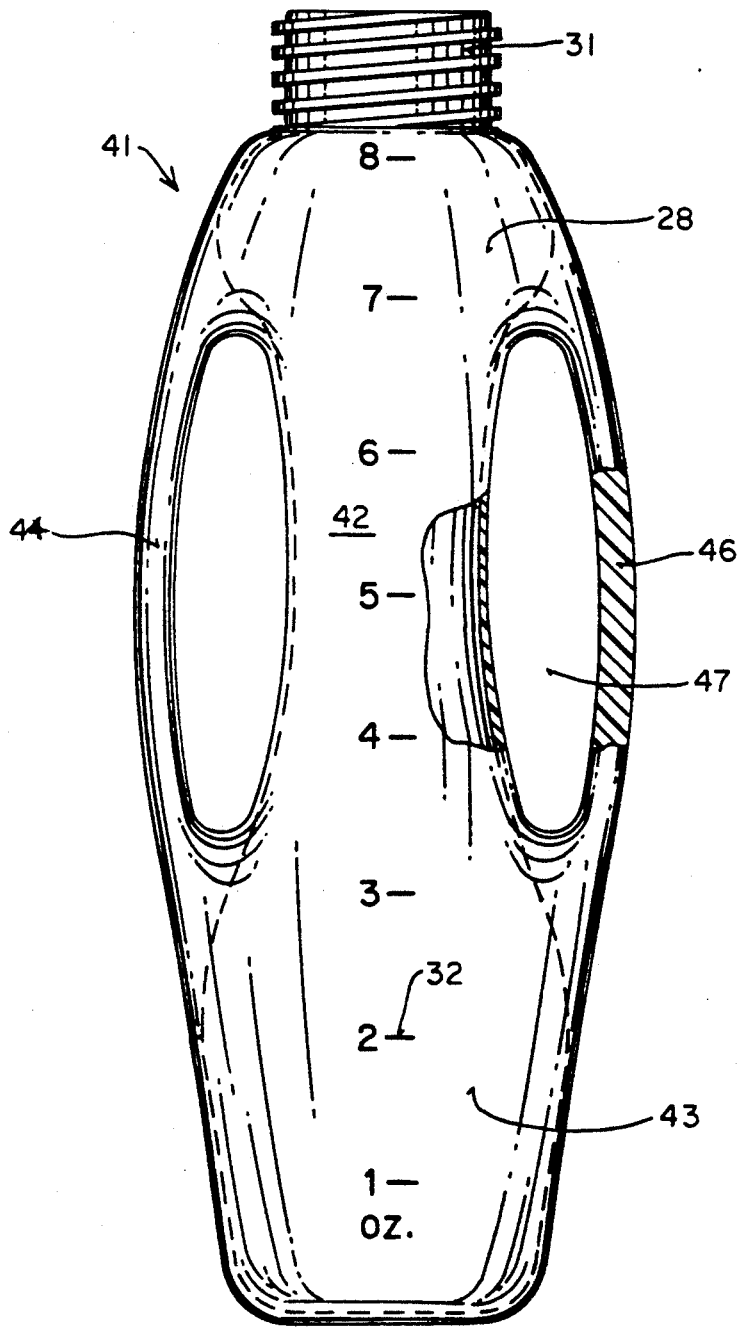
FIG. 6 is a front elevational view of a third embodiment of my infant nursing bottle.

Referring now to the embodiment of the invention illustrated in FIG. 6, it will be noted that this embodiment is quite similar to the embodiment of the invention illustrated in FIG. 4, and accordingly, similar elements of the infant nursing bottle of FIG. 6 carry the same reference number of similar elements in the infant nursing bottle of FIG. 4. The infant nursing bottle of FIG. 6 is designated generally by the numeral 41, and includes a hollow central portion 42 somewhat shorter than the central portion 23 of the embodiment illustrated in FIG. 4, and having a somewhat larger hollow bottom portion 43 communicating with the hollow interior of the hollow central portion 42. Comparing the illustration of the embodiment in FIG. 6 with the illustration of the embodiment in FIG. 4, it will be seen that the handles 44 and 46 in FIG. 6 are somewhat higher on the bottle than the handles illustrated in FIG. 4, and that the waist of the hollow central portion 42 is also somewhat higher and of lesser diameter than the central hollow portion 23 of the embodiment of FIG. 4. In like manner, the opening 47 formed between the waist of the hollow central portion 42 and the handles 44 and 46 is somewhat shorter, and is formed higher on the bottle closer to the upper hollow portion 28 thereof. It is noted that when infants feed, in most instances they feed either when they are lying on their side, or when they are lying on their back. In either case, the milk or other liquid contained in the bottle, will run into the upper hollow interior portion 28 of the bottle, to provide stability to the bottle when the infant grasps both of the handles 44 and 46, or even one of the handles, the center of gravity of the bottle of course shifting toward the outlet end 31 of the bottle while nursing is proceeding. As with the other embodiments of the invention, the side wall of the hollow central portion of the bottle is marked with appropriate indicia to indicate the volumetric capacity of the bottle.

Figure 7:
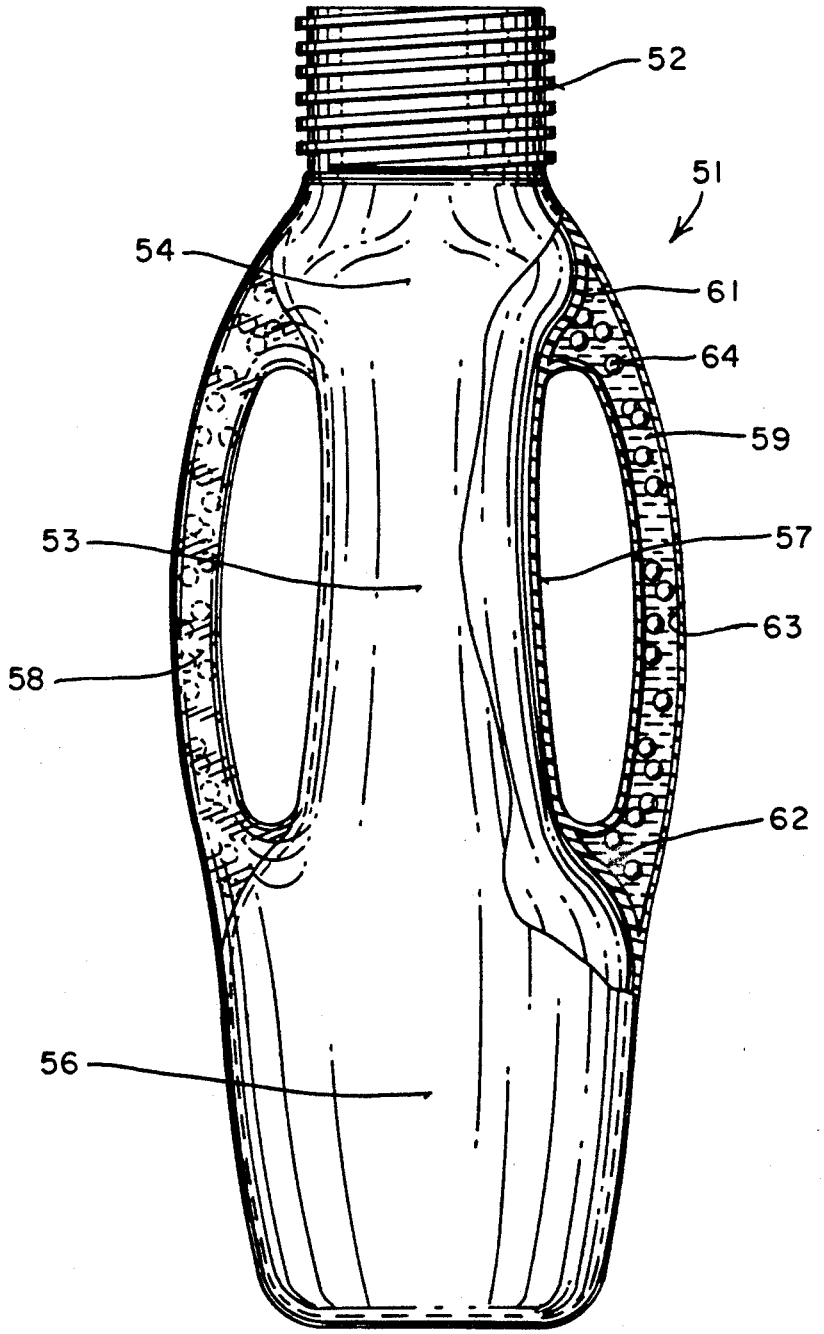
FIG. 7 is a front elevational view of a fourth embodiment of my infant nursing bottle.
Figure 8:
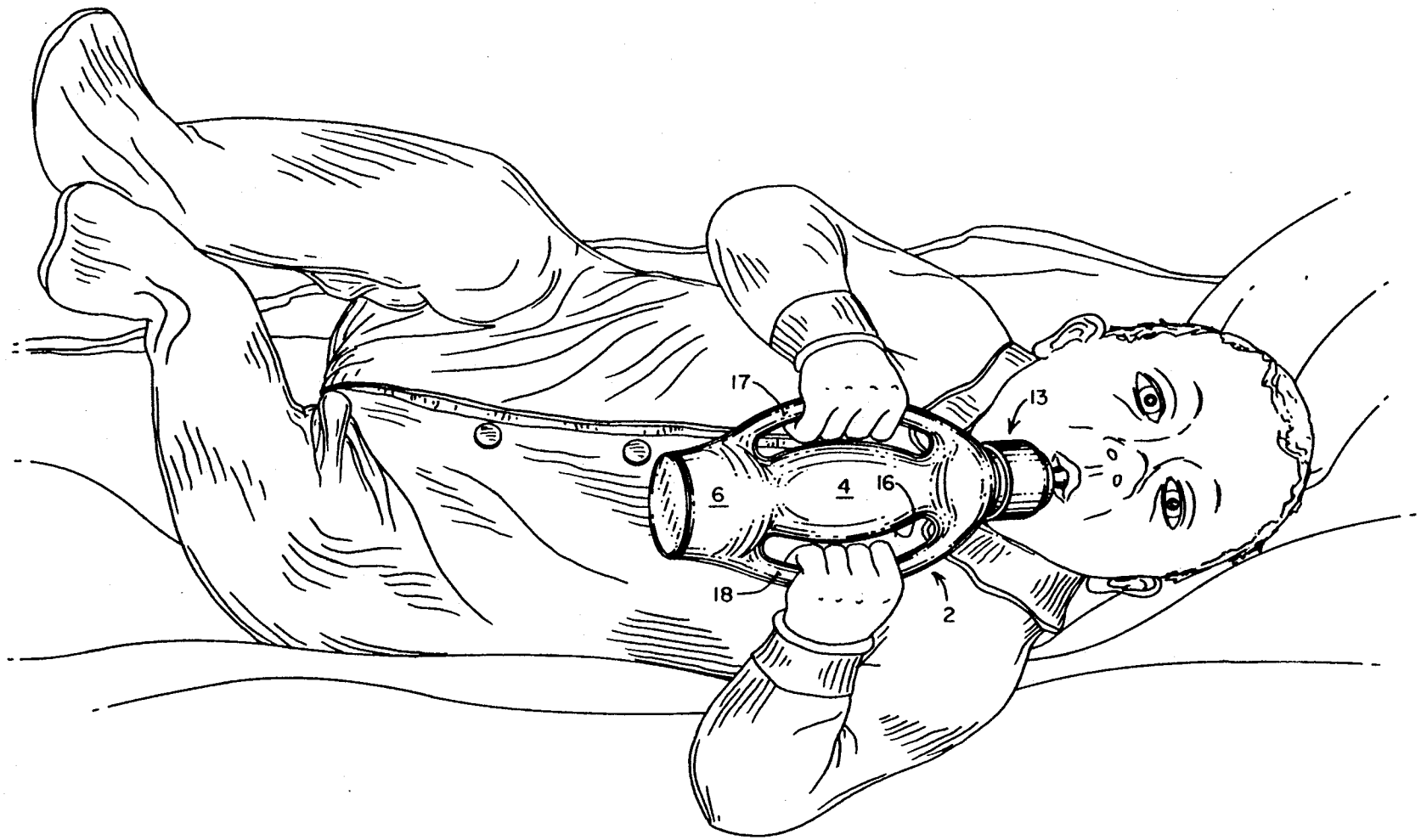
FIG. 8 is a perspective view illustrating the bottle of FIG. 1 grasped by the handles and held in feeding position by an infant.

The embodiment of the infant nursing bottle of the invention illustrated in FIG. 7 is similar in many respects to the embodiments illustrated in FIGS. 1 through 6, but is also different in some respects. Here, the infant nursing bottle is designated generally by the numeral 51, and as with the other embodiments, is provided with a tubular flange 52 having external threads for attachment of a nipple assembly (not shown) so that the infant may draw on the liquid contained within the infant nursing bottle. As with the other embodiments, this bottle contains a hollow central portion 53 communicating with an upper hollow portion 54 and a lower hollow portion 56. The hollow central portion 53 is provided with side walls 57 that are concave as shown, making it possible for an infant to grasp the central portion of the bottle. In addition, this bottle is provided with handles 58 and 59 that are molded integrally with the side walls 57 of the bottle, and which project radially outwardly at diametrically opposed locations on the side of the bottle as shown. In this embodiment of the invention, the handles 58 and 59 are hollow in the same manner that the handles 17 and 18 of the embodiment of FIG. 1 are hollow, but in the embodiment of FIG. 7, the hollow handles 58 and 59 are blocked or sealed against communication with the interior of the bottle by appropriate walls 61 where the handles join the upper hollow portion 54, and walls 62 where the hollow handles 58 and 59 join the hollow lower bottle portion 56. Since the bottle is molded from a synthetic resinous material that is impervious to liquids, i.e., liquid will wet the inside of the bottle, but will not pass through the walls thereof, the interiors of the handles 58 and 59 present the opportunity of providing decorative colored liquid 63 within the handles, the liquid containing either bubbles or other solid matter 64 that will float in the liquid contained and trapped within the hollow handles 58 and 59. Such colored liquid and the floating objects that it contain provide a decorative effect to the bottle that is immediately attractive to an infant and to those Who care for the infant.

It will thus be seen that in each of the embodiments illustrated in the drawings and described above, the infant is able to grasp the two handles that project from opposite sides of the bottle in order to conveniently hold the bottle in a feeding position. Because of the accessibility of the handles, it is even possible for the infant to grasp and hold the bottle with one hand if that should occur to it.

While I have illustrated and described embodiments that include a hollow central portion that includes a waist generally medianly positioned between the upper and lower ends of the bottle, it is contemplated that the bottle may be generally cylindrical over its entire length, having an outer wall on opposite diametric sides that is recessed sufficiently to accommodate diametrically opposed handles that lie within the general outline of the generally cylindrical surface of the bottle, yet provide the openings through which the infant may insert its fingers. While such a configuration has not been illustrated in the drawings, it is believed to be within the scope and spirit of the invention illustrated and described.

Having thus described the invention, what is believed to be new and novel and sought to be protected by letters patent of the United States is as follows.

I claim:

1. An infant nursing bottle having a predetermined maximum volumetric capacity adapted to contain liquid nourishment for an infant and adapted to detachably receive a nipple assembly thereon through which an infant may draw liquid nourishment from the bottle, said bottle comprising:

a) an elongated hollow body having side walls symmetrical about a longitudinal axis and having a hollow closed end portion, a hollow open end portion, means for connecting said hollow open end portion with said nipple assembly, and a hollow central portion intermediate said hollow closed and open end portions and communicating therebetween; and b) a pair of handles molded unitarily in one piece with said bottle, said handles each merging at a first end with said hollow open end portion and side wall, and merging at a second end with said hollow closed end portion and a side wall, and said handles, intermediate their ends, spaced from diametrically opposite side walls of said hollow central portion to provide openings between said handles and the associated side walls of the hollow central portion through which openings an infant may insert its fingers to grasp said handles to hold said nursing bottle in feeding position;

c) said handles possessing hollow interiors sealed from the hollow interior of said elongated hollow body and therefore do not contribute to the volumetric capacity of said hollow body.

2. An infant nursing bottle having a predetermined maximum volumetric capacity adapted to contain liquid nourishment for an infant and adapted to detachably receive a nipple assembly thereon through which an infant may draw liquid nourishment from the bottle, said bottle comprising:

a) an elongated hollow body having side walls symmetrical about a longitudinal axis and having a hollow closed end portion, a hollow open end portion, means for connecting said hollow open end portion with said nipple assembly, and a hollow central portion intermediate said hollow closed and open end portions and communicating therebetween; and b) a pair of handles integral at each end with said side walls of said hollow body and intermediate their ends spaced from diametrically opposite side walls of said hollow central portion to provide openings between said handles and the associated side walls of the hollow central portion through which openings an infant may insert its fingers to grasp said handles to hold said nursing bottle in feeding position;

c) said handles possessing hollow interiors sealed form the hollow interior of said elongated hollow body and therefore do not contribute to the volumetric capacity of said hollow body;

d) said hollow handles containing a liquid.

3. The nursing bottle according to claim 2, wherein said liquid contained within the hollow handles contains visually perceptible objects floating freely in the liquid and moveable within the hollow handles.

4. The nursing bottle according to claim 2, wherein said liquid is of a color that contrasts with the material from which the handles are formed whereby said colored liquid is visible within the handles.

* * * * *